US007146020B2

(12) United States Patent
Peng

(10) Patent No.: US 7,146,020 B2
(45) Date of Patent: Dec. 5, 2006

(54) STRUCTURE FOR THE SOUND COIL OF LOUDSPEAKER

(75) Inventor: Jack Peng, Taipei (TW)

(73) Assignee: Meiloon Industrial Co., Ltd., Taipei (TW)

( * ) Notice: Subject to any disclaimer, the term of this patent is extended or adjusted under 35 U.S.C. 154(b) by 336 days.

(21) Appl. No.: 10/299,835

(22) Filed: Nov. 20, 2002

(65) Prior Publication Data

US 2004/0096080 A1 May 20, 2004

(51) Int. Cl.
*H04R 25/00* (2006.01)

(52) U.S. Cl. ..... 381/409; 381/400; 381/410

(58) Field of Classification Search ..... 381/400–402, 381/406–410

See application file for complete search history.

(56) References Cited

U.S. PATENT DOCUMENTS 2,922,850 A * 1/1960 Zuerker ..... 381/409
4,300,022 A * 11/1981 Hastings-James et al. .. 381/121
4,539,442 A * 9/1985 Puls et al. ..... 381/409
5,249,236 A * 9/1993 Sakamoto ..... 381/409
6,421,449 B1 * 7/2002 Hasegawa et al. ..... 381/401
6,587,571 B1 * 7/2003 Fujihira et al. ..... 381/407

* cited by examiner

*Primary Examiner*—Suhan Ni
(74) *Attorney, Agent, or Firm*—Troxell Law Office, PLLC

(57) ABSTRACT

An improved structure for the sound coil of loudspeaker comprises a cylinder provided with multiple layers of coils surrounding one end thereon. The coils are divided into sections in the middle position which provide more than two conducting wires. The cylinder is rolled by a single plate and is provided with four layers of coils. The conducting wire extends to the other end of cylinder and is wrapped with oilpaper; and connects to a piece of thick wire. The cylinder is provided with several ventilation holes. Every two layers of coil being a independent wire material, the sound coil comprised four conducting wires; or each layer of coil being a independent wire material, the sound coil comprised eight conducting wires. Thus the sound coil produces larger output power and reduces the size of sound coil, the coils surrounding the cylinder, production costs, and the size of products.

3 Claims, 7 Drawing Sheets

Prior Art

STRUCTURE FOR THE SOUND COIL OF LOUDSPEAKER

BACKGROUND OF THE INVENTION

1. Field of the Invention

The present invention relates to an innovation of sound coil for loudspeaker, especially referring to an improved structure for the sound coil of loudspeaker provided with multiple conducting wires to increase output power. Thus the production requires less coils and the size of loudspeaker is reduced.

2. Description of the Prior Art

Music is a part of human's civilization throughout the history. The ancestors passed down music to the next generations via musical notes and musicians. With the phonograph invented by Edison, people could record music in a brand new way. Now, stereo equipment has become an indispensable appliance for the leisure life. As a result of informational technological advancement, the sound output equipment is becoming more important than ever and, consequently, the loudspeakers with various functions and shapes have been presented to the market. Now the electric appliances are designed in a complicated manner and the loudspeaker has become smaller than before in order to save space.

Sound coil is an important part for loudspeaker. The conventional sound coil of loudspeaker comprises a cylinder provided with coils surrounding one end thereon. There are two discriminations for two conducting wires or single conducting wire. However, the number of layers of coils surrounding the cylinder are the same for all sound coils. In general, the conventional sound coil of loudspeaker comprises a cylinder surrounded with four layers of coils. With the fixed number of layers and the fixed structure of conducting wire, following disadvantages become apparent for the conventional sound coils:

1. To produce a certain level of output power, the loudspeaker has to be provided with a certain length of coils; and thus production costs cannot be reduced.
2. To cope with the fixed length of coils, it is unlikely to reduce the circumference of cylinder and, therefore, the size of loudspeaker cannot be reduced.

The inventor has studied the foregoing problems thoroughly and conducted numerous tests to improve the structure of sound coils; then created the present invention.

SUMMARY OF THE INVENTION

The present invention relates to an improved structure for the sound coils of loudspeaker provided with multiple conducting wires to enhance the output power; and thus fewer coils are needed and the size of loudspeaker is reduced.

To serve the foregoing purpose, the present invention comprises a cylinder provided with multiple layers of coils surrounding one end thereon; the coils are divided into several sections in the middle position which provide more than two conducting wires. The cylinder is rolled by a single plate with four layers of coils surrounding thereon. The conducting wire extends to the other end of cylinder and is wrapped with oilpaper; and in the end of the conducting wire connects to a piece of thick wire. The cylinder is provided with several ventilation holes. Every two layers of coils being a wire material for independent section, thus, the sound coil comprises four conducting wires; or each layer of coil being a wire material for independent section, thus, the sound coil comprises eight conducting wires. Thus the sound coil outputs more power and the size of loudspeaker is reduced; fewer coils are needed; and the production costs and the size of loudspeaker are, therefore, reduced.

The present invention will be apparent in its contents of technique after reading the detailed description of the preferred embodiments of the present invention in reference to the accompanying drawings, wherein:

DETAILED DESCRIPTION OF THE PREFERRED EMBODIMENT

Figure 1:
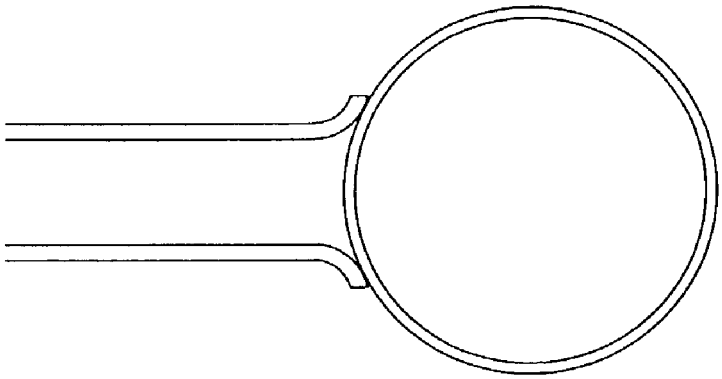
FIG. 1 shows the difference of sizes between conventional structure and present invention.
Figure 1:
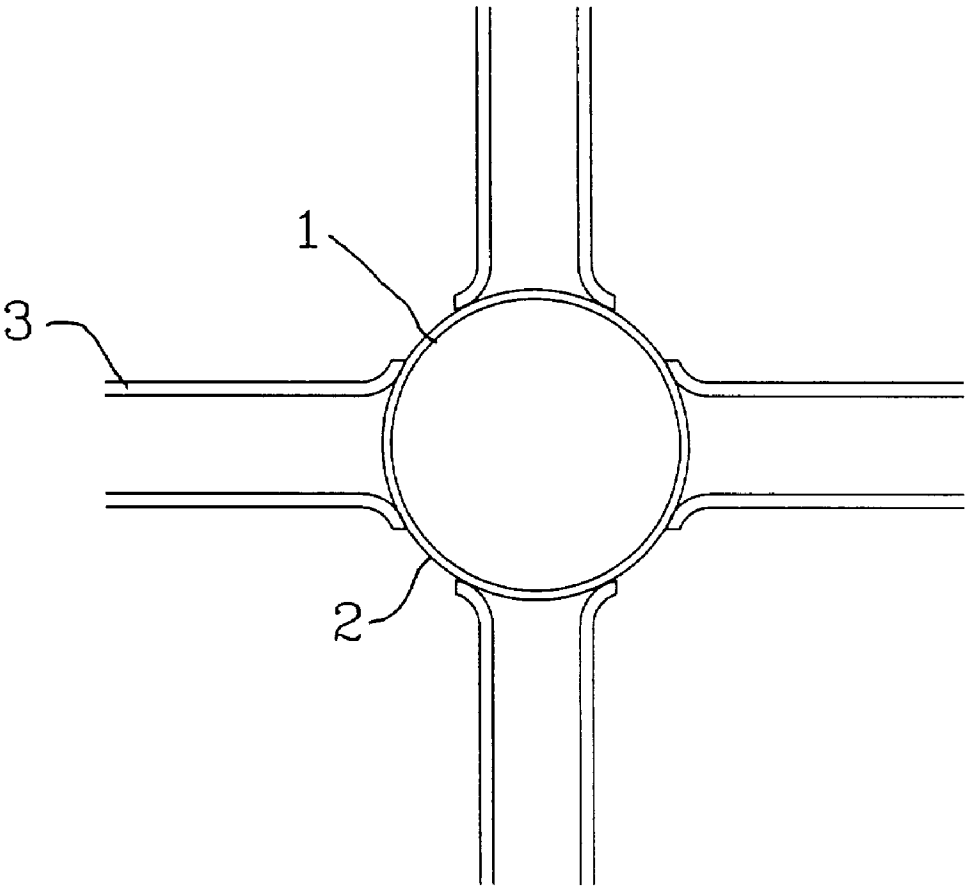
Figure 2:
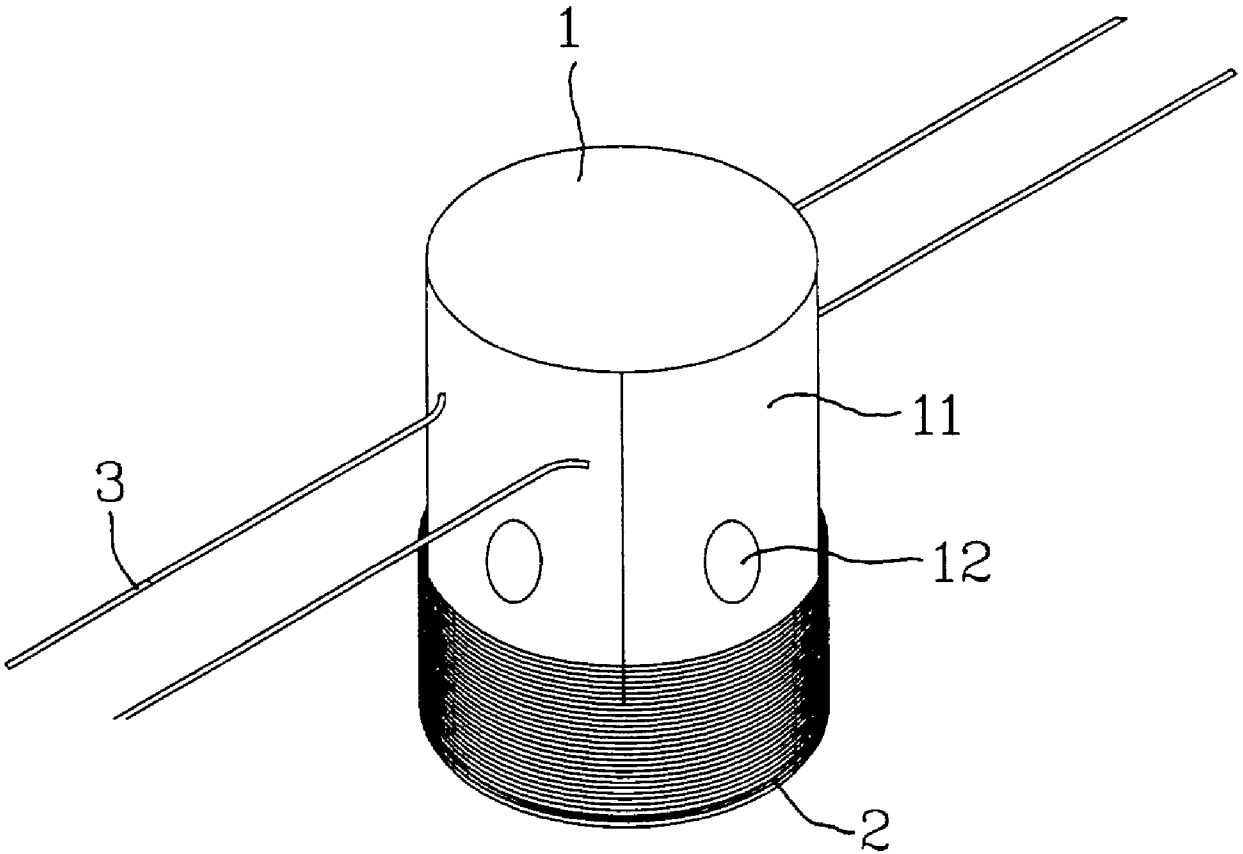
FIG. 2 is the stereoscopic view of present invention.
Figure 3:
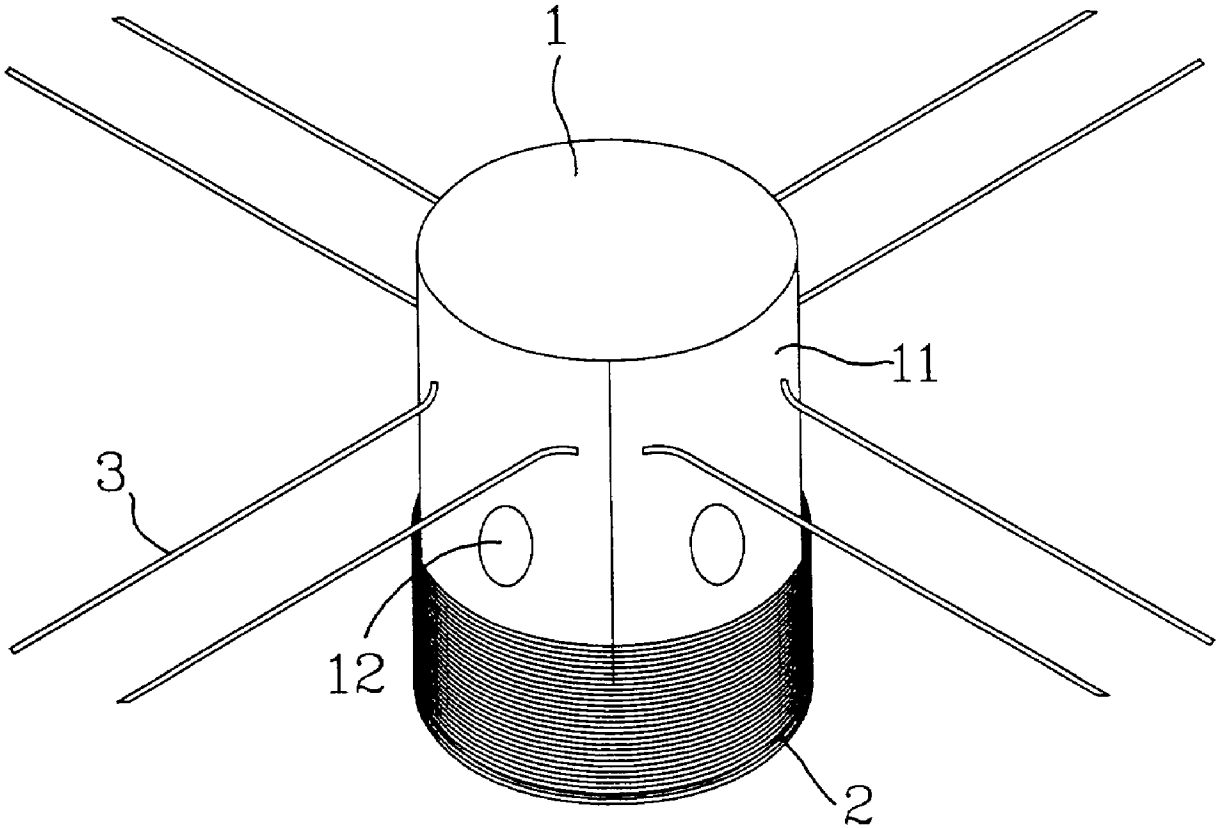
FIG. 3 is another stereoscopic view of present invention.
Figure 4:
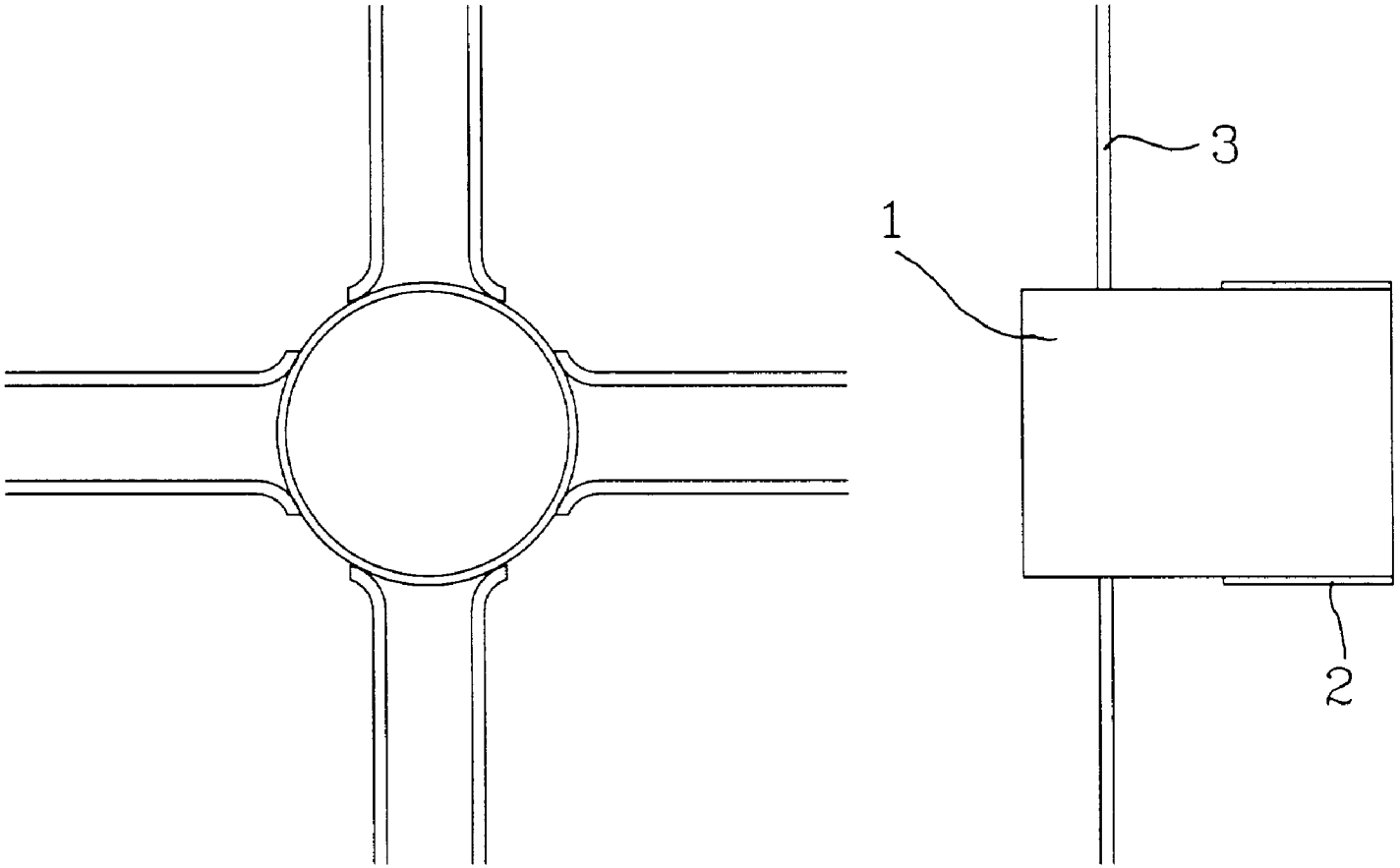
FIG. 4 is the plane figure of the sound coil of present invention.
Figure 5:
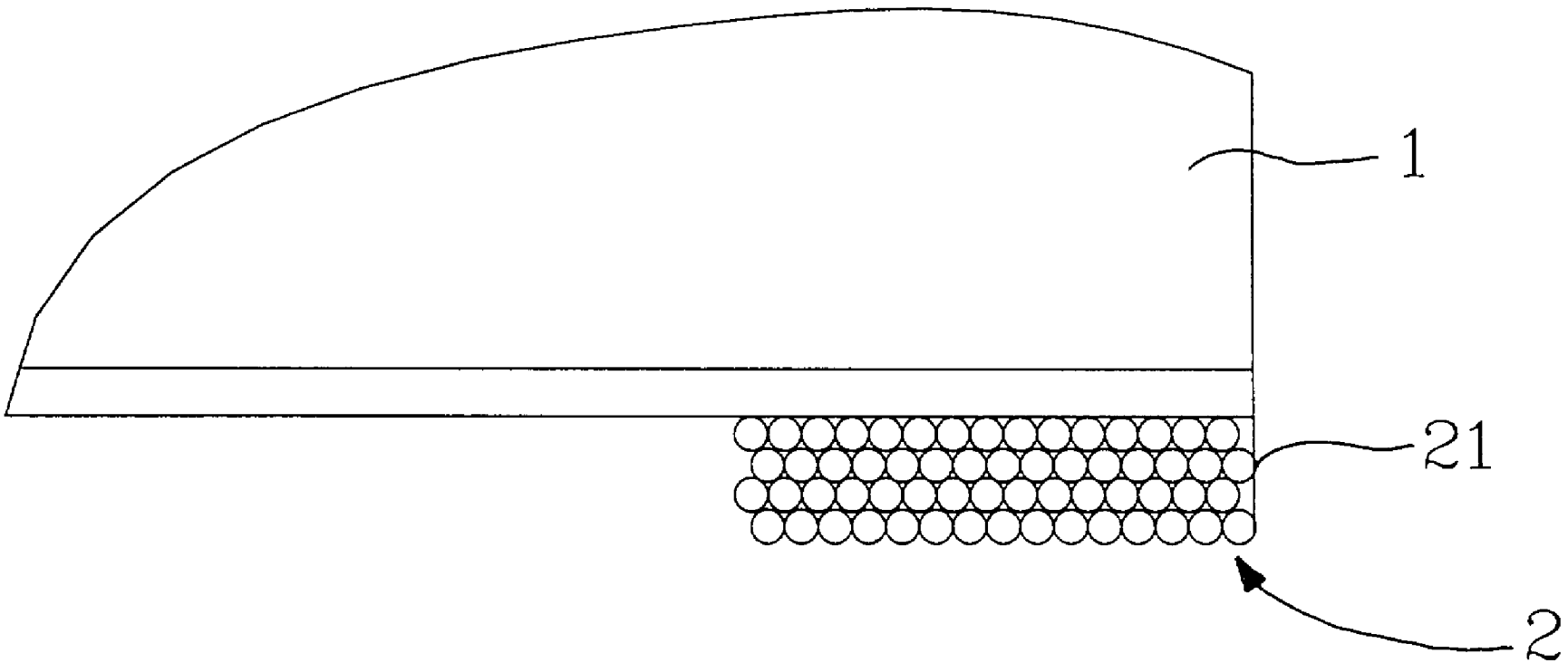
FIG. 5 is the partial sectional view of the sound coil of present invention.
Figure 6:
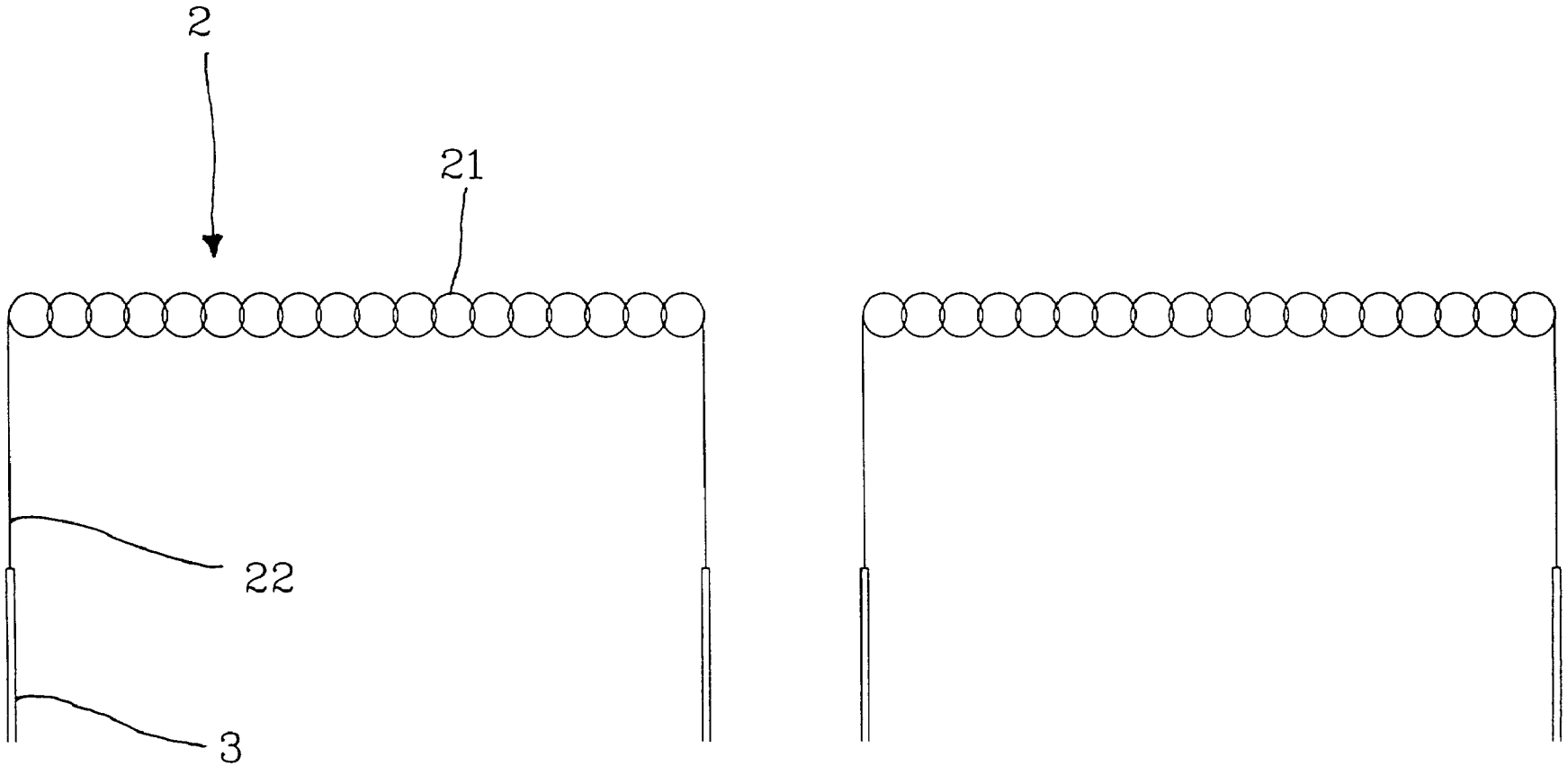
FIG. 6 shows the spreading wire distribution of present invention with four conducting wires.
Figure 7:
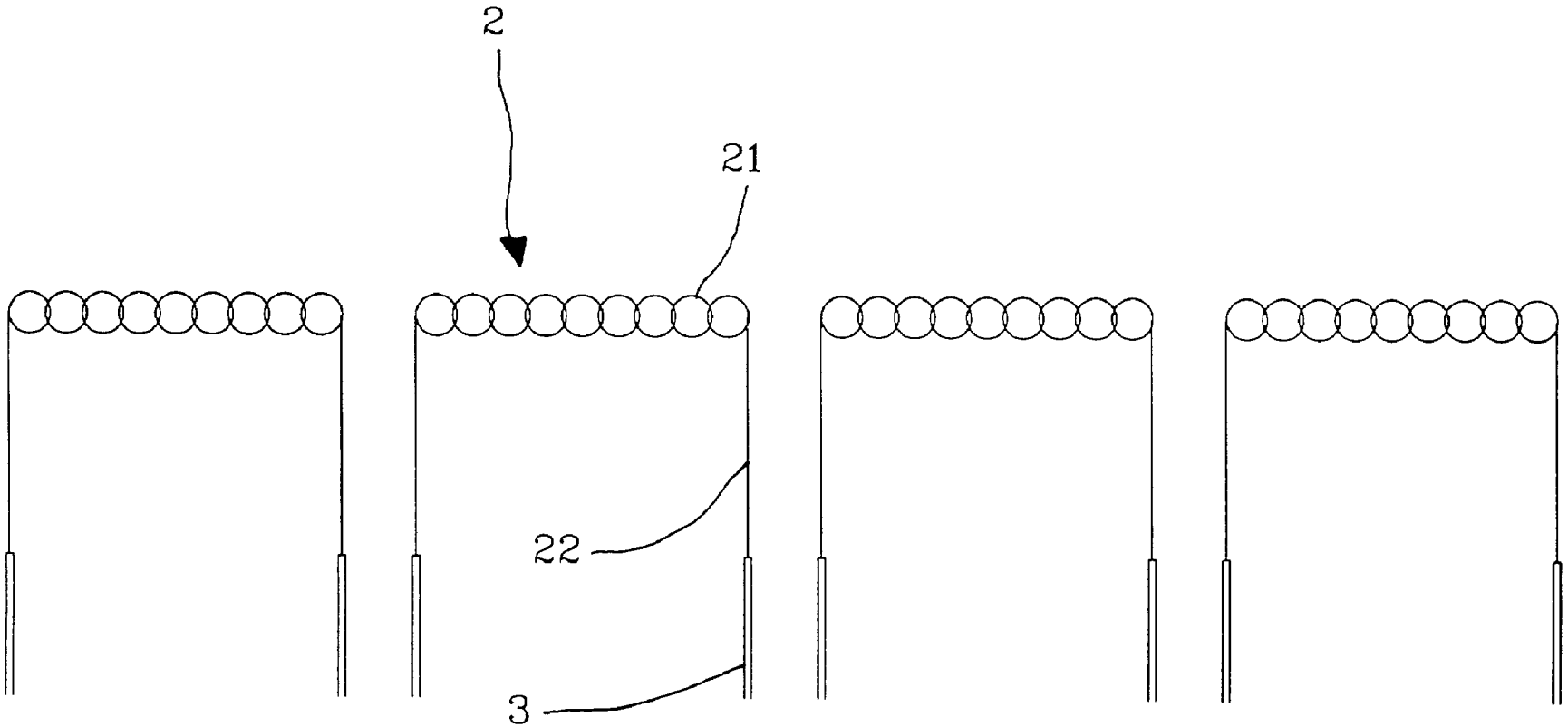
FIG. 7 shows the spreading wire distribution of present invention with eight conducting wires.

As shown by FIG. 1~FIG. 7, the present invention comprises:

a cylinder 1 provided with multiple layers of coils 2 surrounding one end thereon and being divided into several sections 21 in the middle position; each section 21 being provided with conducting wires 22; and the conducting wires 22 being more than two ones when sound coil assembly completed; and a cylinder 1 being rolled by a single plate and provided with four layers of coils 2; the conducting wire extending to the other end of cylinder and being wrapped with oilpaper 11; the end of conducting wire connecting to a piece of thick wire 3; and the cylinder 1 being provided with several ventilation holes 12.

Every two layers of coils 2 being a wire material for independent section 21, thus, the sound coil comprises four conducting wires 22; or each layer of coil 2 being a wire material for independent section 21, thus, the sound coil comprises eight conducting wires 22.

With the multiple sections 21, the sound coils produce larger output power. The loudspeaker can be reduced to the size shown by FIG. 1 and produce the same level of power. Thus fewer coils are needed when the loudspeaker is provided with the coils divided into sections 21. Therefore, the production costs and the size of loudspeaker are reduced.

As described in the preceding statement, fewer coils are needed for present invention and the size of sound cols is reduced. The present invention is superior to the conventional sound coils regarding functions. Therefore, the present invention is industrially valuable.

The present invention has been described in conjunction with the preferred embodiment. To those skilled in the art, modification may be made in the invention without departing from the spirit and scope of the subject invention as set forth in the claims below.

Having thus described my invention, what the inventor claims as new and desire to be secured by Letters Patent of the United States include:

The invention claimed is:

1. A reduced size sound coil for a loudspeaker comprising:

a) a cylinder;

b) a plurality of layers of coils located on a first end of the cylinder and having four or eight conducting wires extending toward a second end of the cylinder; and c) a plurality of thick wires protruding from the cylinder, each of the plurality of thick wires is connected to one of the plurality of conducting wires, wherein the reduced size sound coil is configured to be substantially smaller than a larger sound coil employing a total of only two conducting wires, the reduced size sound coil being further configured to output substantially the same power as the larger sound coil employing the total of only two conducting wires.

2. The sound coil according to claim 1, wherein the cylinder having a plurality of ventilation holes.

3. The sound coil according to claim 1, wherein the plurality of layers of coils includes four layers of coils.

* * * * *